US005667467A

United States Patent [19]

Walsh et al.

[11] Patent Number: 5,667,467

[45] Date of Patent: Sep. 16, 1997

[54] METHOD FOR FORMING AN EFFECTIVE SEAL FOR A CARTON

[75] Inventors: Joseph Christopher Walsh, Longmont; Kenneth E. Hawkins, Loveland, both of Colo.

[73] Assignee: Graphic Packaging Corporation, Paoli, Pa.

[21] Appl. No.: 513,359

[22] Filed: Aug. 10, 1995

[51] Int. Cl.[6] ..... B31B 1/14

[52] U.S. Cl. ..... 493/342; 493/373

[58] Field of Search ..... 493/342, 360, 493/363, 369, 370, 372, 373, 371, 83, 82, 62, 63; 156/257, 258, 263, 267, 270, 247, 248, 344; 428/43; 229/208, 247

[56] References Cited

U.S. PATENT DOCUMENTS

| | | | |
|---|---|---|---|
| 1,255,810 | 2/1918 | Taylor | 493/370 |
| 1,845,891 | 2/1932 | Schroeder | 493/62 |
| 2,048,301 | 7/1936 | Stokes et al. | 493/62 |
| 2,552,353 | 5/1951 | Troth et al. | 493/363 |
| 2,576,594 | 11/1951 | Goldstein | 493/62 |
| 3,357,322 | 12/1967 | Gill | 493/82 |
| 3,603,219 | 9/1971 | Mallis, Jr. | 493/62 |
| 3,604,317 | 9/1971 | Baun | 493/287 |
| 3,920,122 | 11/1975 | Koechlinger et al. | 156/257 |
| 4,188,251 | 2/1980 | Grass et al. | 156/248 |
| 4,220,272 | 9/1980 | Danti | 493/342 |
| 4,246,058 | 1/1981 | Reed | 156/248 |
| 4,931,031 | 6/1990 | Lisiecki | 493/62 |

OTHER PUBLICATIONS

U.S. Application No. 08/336,982, Walsh et al., Filed Nov. 14, 1994.

*Primary Examiner*—Joseph J. Hail, III
*Assistant Examiner*—Darren Ark
*Attorney, Agent, or Firm*—Klaas, Law, O'Meara & Malkin, P.C.; Joseph J. Kelly

[57] ABSTRACT

A method for providing paperboard to paperboard facing surfaces for forming an effective seal for cartons formed from a laminate of a relatively flexible fluid impervious material and a relatively rigid paperboard material.

6 Claims, 1 Drawing Sheet

METHOD FOR FORMING AN EFFECTIVE SEAL FOR A CARTON

FIELD OF THE INVENTION

This invention relates generally to paperboard cartons and more particularly to a method for forming an effective seal for a paperboard carton.

BACKGROUND OF THE INVENTION

Many paperboard cartons presently on the market are formed from a laminate of a reverse printed or surface print plastic film adhesively secured to a paperboard or other similar material. When sealing the folded top and bottom panels, it is necessary to use a more expensive adhesive to form an effective seal of the paperboard to the plastic film. Therefore, it is desirable to form an effective seal and better performance for cartons made from this laminated material using an inexpensive adhesive.

BRIEF DESCRIPTION OF THE INVENTION

This invention provides an effective seal for the top and bottom panel portion for a carton formed from a laminated material comprising a plastic film secured to a paperboard or other similar material by removing a portion of the plastic film to provide paperboard to paperboard facing surfaces for forming an effective seal.

In a preferred embodiment of the invention, a continuous laminate of a relatively rigid material, such as a paperboard, and a relatively flexible fluid impervious material, such as a polypropylene or a kraft paper coated with polypropylene or a kraft paper coated with polyethylene or other materials having similar characteristics, is divided into individual carton blanks and each individual carton blank is provided with conventional cut lines and fold lines to define sidewall panel portions, a glue tab panel portion, and top and bottom panel portions. Also, each individual carton blank is provided with additional cut lines that only extend through portions of the relatively flexible fluid impervious material to provide for the removal of these portions to provide paperboard to paperboard facing surface for forming an effective seal using a relatively inexpensive adhesive.

BRIEF DESCRIPTION OF THE DRAWING

An illustrative and presently preferred embodiment of the invention is shown in the accompanying drawing in which.

DETAILED DESCRIPTION OF THE INVENTION

Figure 1:
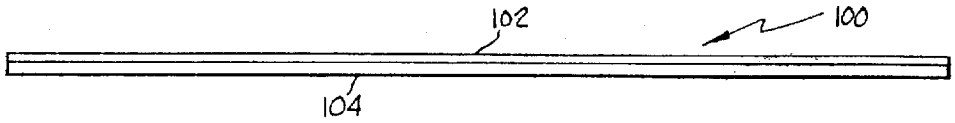
FIG. 1 is a side elevational view of a carton blank.
Figure 2:
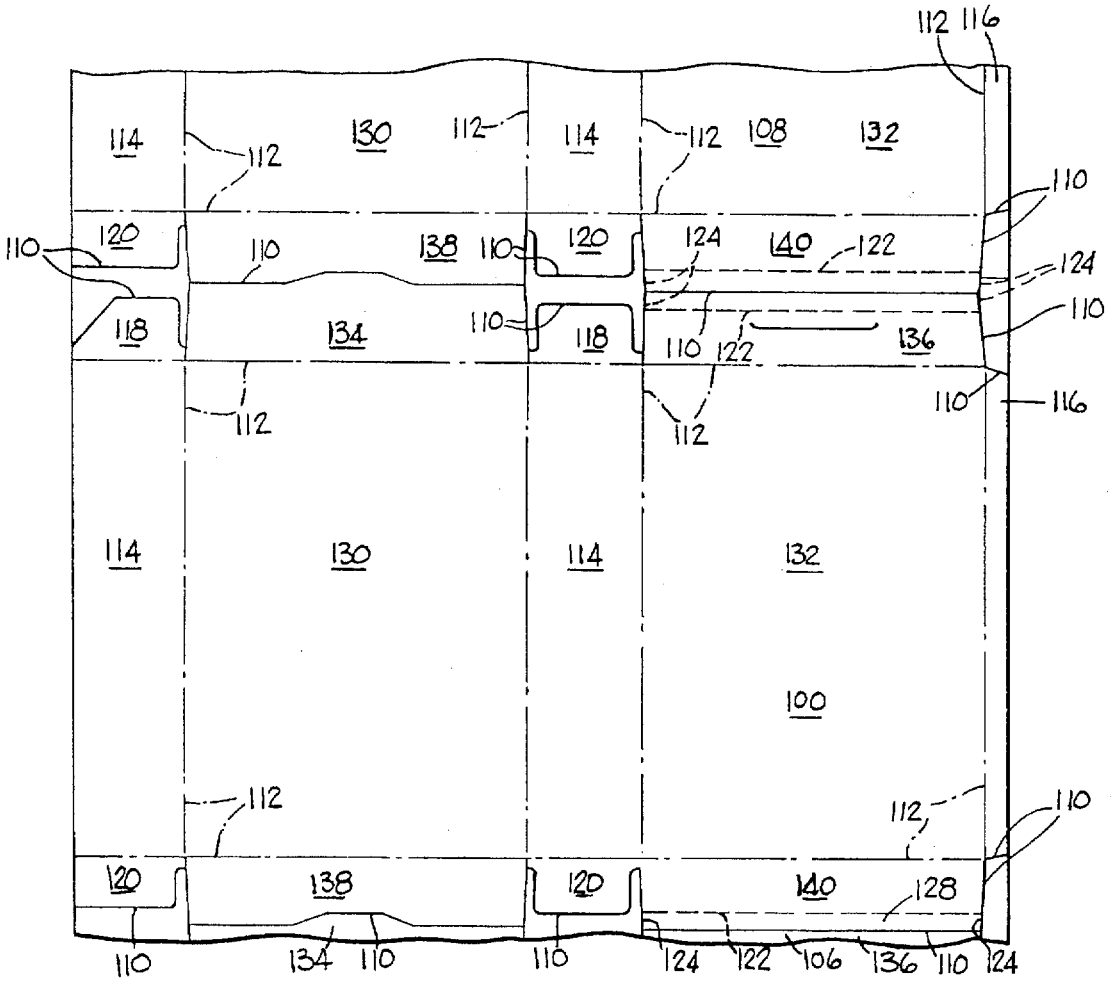
FIG. 2 is a top plan view of FIG. 1.
Figure 3:
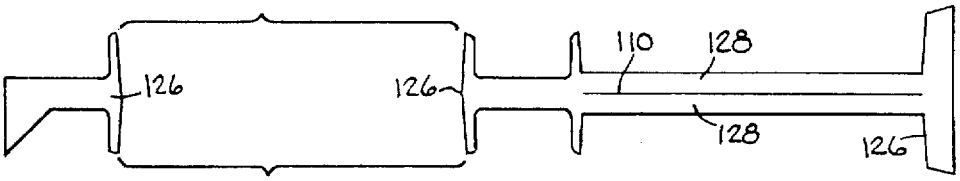
FIG. 3 is a top plan view of the portions removed from FIG. 2.

A preferred embodiment of the invention is illustrated in FIGS. 1–3. A carton blank 100 is formed as laminate of a relatively flexible fluid impervious material, such as a plastic film 102 as described above, is secured to a relatively rigid material, such as paperboard material 104. In FIG. 2, there is illustrated one carton blank 100 and portions of two adjacent carton blanks 106 and 108. The carton blanks 100, 106 and 108 are provided with cut lines 110 and fold lines 112 to divide the carton blanks 100, 106 and 108 into plurality of sidewall panel portions 114, a front panel portion 130, a back panel portion 132 a glue tab panel portion 116, top sidewall panel portions 118, top front panel portion 134, top back panel portion 136, bottom sidewall panel portions 120, a bottom front panel portion 138 and a bottom back panel portion 140 each having an outer edge portion. The cut lines 110 extend completely through the plastic film 102 and the paperboard material 104. Additional cut lines 122 are generally parallel to the outer edge portions of selected top and bottom back panel portions and extend completely through the plastic film 102 and only partially into the paperboard material 104. In some instances, the additional cut lines 122 will not extend into the paperboard material 104. Supplemental cut lines 124 are generally perpendicular to the cut lines 122 and extend substantially through the paperboard material 104 but not into the plastic film 102. Although two supplemental cut lines 124 are illustrated in each of the top 118 and bottom 120 panel portions, it is only necessary to have the supplemental cut lines 124 at the leading portion of the top 118 and bottom 120 panel portions in the direction of movement of the continuous laminate 34 as it moves through the cutting and creasing apparatus.

When forming a carton from the carton blank 100, 106 or 108, it is desirable to use the most inexpensive adhesive. However, it is difficult to obtain a good seal of one top front panel portion 134 to top back panel portion 136 or of bottom front panel portion 138 to bottom back panel portion 140 because of the plastic film 102. The additional cut lines 122 and the supplemental cut lines 124 allow portions of the relatively flexible fluid impervious plastic film 102 to be removed from a port of the top back panel portion 136 and from a portion of the bottom back panel portion 140. The removed portions are illustrated in FIG. 3. Portions 126 comprise both the plastic film 102 and the relatively rigid paperboard material 104. Portions 128 comprise the plastic film 102 and, in most instances, the portions of the paperboard material that are directly secured to the plastic film 102 leaving behind the major portion of the paperboard material. When the portions 128 are removed, they expose a portion of the paperboard material 104 of the top back panel portion 136 or bottom back panel portion 140 so that an effective seal can be obtained between the exposed surface of the paperboard material of the top back panel portion 136 and the paperboard material 104 of the covering top or bottom 118 and 120 panel portion 134 and the exposed surface of the bottom back panel portion 140 and the paperboard material of the covering bottom front panel portion 138 so that relatively inexpensive adhesive can be used. The removed portion 128 of the relatively flexible fluid impervious plastic material 102 extends from one cut line 110 of a top 118 or bottom 120 panel portion to the opposite cut line 110 thereof. The additional cut lines 122 are spaced from the outer edge portions of the top back panel portion 136 or bottom back panel portion 140 only a distance required to form an effective seal and allow the other portions of the relatively flexible fluid impervious material to be visible.

While an illustrative and presently preferred embodiment of the invention has been described in detail herein, it is to be understood that the inventive concept may be otherwise variously embodied and employed and that the appended claims are intended to be construed to include such variations except insofar as limited by the prior art.

What is claimed:

1. A method for forming a carton blank from a continuous laminate comprising at least a layer of a relatively flexible fluid impervious material secured to at least a layer of a relatively rigid material comprising:

dividing said continuous laminate to form individual carton blanks;

making conventional cut lines and fold lines in each of said individual carton blanks to form top front, back and sidewall panel portions and bottom front, back and sidewall panel portions, front, back and sidewall panel portions and a glue tab panel portion;

providing each of said top front and back panel portions and said bottom front and back panel portions with an outer edge portion;

making at least one additional cut line only in at least one of said top front and back panel portions and only in at least one of said bottom front and back panel portions and each of said at least one additional cut line being spaced from said outer edge portion thereof;

extending each of said at least one additional cut lines only completely through said relatively flexible fluid impervious material and not all the way through said relatively rigid material; and removing said relatively flexible fluid impervious material between said at least one additional cut line and said outer edge portions to expose portions of said relatively rigid material of said at least one of said tog front and back panel portions and of said at least one of said bottom front and back panel portions to be used with superposed portions of said relatively rigid material of the other of said top front and back panel portions and the other of said bottom front and back panel portions in forming an effective seal.

2. A method as in claim 1 and further comprising:

extending each of said at least one additional cut;

lines at least partially into said relatively rigid material.

3. A method as in claim 1 and further comprising:

making at least one supplemental cut line in each of said at least one of said top front and back panel portions and said front and back bottom panel portions perpendicular to said at least one additional cut line and extending at least substantially through said paperboard material but not said plastic film and located between each of said at least one additional cut lines and said outer edge portion.

4. A method for forming a plurality of individual carton blanks from a continuous laminate comprising at least a relatively flexible fluid impervious material secured at least to portions of a layer of a relatively rigid material comprising:

dividing said continuous laminate to form a plurality of individual carton blanks;

making conventional cut and fold lines in each of said individual carton blanks to form top front, back and sidewall panel portions and bottom front, back and side, all panel portions, front, back and sidewall panel portions and a glue tab panel portion;

providing each of said top front and back panel portions and said bottom front and back panel portions with an outer edge portion;

dividing said continuous laminate so that at least one of said top front and back panel portions of one of said individual carton blanks is adjacent to at least one of said bottom front and back panel portions of another of said individual carton blanks with said outer edge portions thereof separated by one of said conventional cut lines;

making at least one additional cut line in said at least one of said top front and back panel portions spaced from said outer edge portion thereof and at least another additional cut line in said at least one of said bottom front and back panel portions spaced from said outer edge-portion thereof;

extending each of said at least one additional cut line and said at least another additional cut line only completely through said relatively flexible fluid impervious material and not all the way through said relatively rigid material; and removing said relatively flexible fluid impervious material between said additional cut lines to expose portions of said relatively rigid material of said at least one of said top front and back panel portions and of said relatively rigid material of and of said at least one of said bottom front and back panel portions to provide compatible sealing surfaces for sealing to superposed portions of the said relatively rigid material of the other of said top front and back panel portions and of the other of said bottom front and back panel portions.

5. A method as in claim 4 and further comprising:

making at least one supplemental cut line in said at least one of said top front and back panel portions perpendicular to said at least one additional cut line therein and extending at least substantially through said relatively rigid material but not into said relatively flexible fluid impervious material and located between said at least one additional cut line and said outer edge; and making at least another supplemental cut line in said at least one of said bottom front and back panel portions perpendicular to said at least another additional cut line therein and extending at least substantially through said relatively rigid material but not into said relatively flexible fluid impervious material and located between said at least one additional cut line and said outer edge to facilitate said formation of said exposed surfaces.

6. A method as in claim 4 and further comprising:

extending each of said at least one additional cut line and said at least another additional cut line at least partially into said relatively rigid material.

* * * * *

UNITED STATES PATENT AND TRADEMARK OFFICE

CERTIFICATE OF CORRECTION

PATENT NO. : 5,667,467

DATED : September 16, 1997

INVENTOR(S) : Joseph Christopher Walsh and Kenneth E. Hawkins

It is certified that error appears in the above-identified patent and that said Letters Patent are hereby corrected as shown below:

Column 2, line 28, "port" should read --portion--.

In the Claims:

Claim 1, Column 3, line 21, "tog" should read --top--.
Claim 2, Column 3, line 30, delete the semicolon ";" after "cut".
Claim 4, Column 3, line 51, "side,all" should be deleted and --sidewall- inserted therefor.
Claim 4, Column 4, line 26, delete "of" (first instance).

Signed and Sealed this

Sixteenth Day of December, 1997

Bruce Lehman

*Attest:*

BRUCE LEHMAN

*Attesting Officer*

*Commissioner of Patents and Trademarks*